US005967432A

United States Patent [19]

Chen

[11] Patent Number: 5,967,432

[45] Date of Patent: Oct. 19, 1999

[54] MILL

[76] Inventor: Yuanxiao Chen, No. 199 Three section, Taishan North Road, Yanghu Zhongduan, Deyang City, Sichuan Province, 618000, China

[21] Appl. No.: 08/952,529

[22] PCT Filed: Jul. 18, 1996

[86] PCT No.: PCT/CN96/00054

§ 371 Date: Nov. 24, 1997

§ 102(e) Date: Nov. 24, 1997

[87] PCT Pub. No.: WO97/03753

PCT Pub. Date: Feb. 6, 1997

[30] Foreign Application Priority Data

Jul. 18, 1995 [CN] China ..... 95106968

[51] Int. Cl.[6] ..... B02C 19/00; B02C 23/08

[52] U.S. Cl. ..... 241/38; 241/48; 241/79.1; 241/275; 241/285.1

[58] Field of Search ..... 241/275, 285.1, 241/285.2, 79.1, 38, 47, 48

[56] References Cited

U.S. PATENT DOCUMENTS

| | | | |
|---|---|---|---|
| 3,155,326 | 11/1964 | Rhodes | 241/53 |
| 4,133,487 | 1/1979 | Lanier | 241/5 |
| 4,436,138 | 3/1984 | Kondo | 164/5 |
| 4,756,484 | 7/1988 | Bechler et al. | 241/275 |
| 5,277,370 | 1/1994 | Schatz | 241/80 |
| 5,330,110 | 7/1994 | Williams | 241/53 |
| 5,690,284 | 11/1997 | Murray | 241/41 |
| 5,706,879 | 1/1998 | Renner et al. | 241/275 X |

*Primary Examiner*—John M. Husar
*Attorney, Agent, or Firm*—Nikaido, Marmelstein, Murray & Oram LLP

[57] ABSTRACT

This invention provides a non-ball mill, which makes the material to circulate at high speed within the mill so as to crush the material by means of the impact and friction among the material themselves. The mill includes base, motor, body for forming milling chamber, return funnel, and outlet port. A shaft driven by a motor penetrates the milling chamber and is provided with a rotating assembly for rotating the material within the milling chamber. The milling chamber consists of an upper chamber and a lower chamber formed respectively by pyramidal upper and lower body, so as to make the material to circulate within the milling chamber. A separating chamber is provided at the upper portion of the upper chamber, and the separator mounted on the shaft output the material of fine size to the outlet port. The mill has the advantageous of less energy consumption, no consumption of steel, light weight, high productivity, reduced wearing rate, small noise and vibration. The mill may be operated in either wet milling or dry milling manner, and combine crushing and separating operation together within a single device.

26 Claims, 6 Drawing Sheets

MILL

BACKGROUND OF THE INVENTION

This invention relates to a non-ball crushing mill, and particularly to a mill in which the material are crushed by the collision and friction between the material during the high speed circulating movement within the mill, without the necessitate of making use of steel balls. This kind of mill has a wide application in various technical fields such as mineral separation, metallurgy, chemistry, building material industry, ceramic industry, and power plant.

DESCRIPTION OF THE PRIOR ART

The existing ball mill makes use of steel balls to crush the material like mineral. A large amount of steel balls will be consumed during this operation. In addition, the hardness of steel balls can only be the level of 7–8, while the hardness of some kind of mineral reaches the level of 8–9, even 10. Therefore, it is either difficult to crush the material or to reach high efficiency by means of the conventional ball mill. On the other hand, the weight of rotating parts and steel balls takes about 95% by weight of the total weight of the rotating portion of a conventional ball mill. This proportion is much higher than that of material to be crushed, therefore the energy consumption needed for obtaining crushed material of unit weight is rather high. The steel balls used in this kind of mill will be worn out during the crushing operation, which will reduce the purity of some kind of products or cause environment contamination. In addition, the ball mill can not be used as a floatation unit simultaneously.

BRIEF DESCRIPTION OF THE INVENTION

One object of this invention is to provide a non-ball mill which makes the material to circulate at high speed within the mill so as to crush the material by the collision and friction produced between the material as such. This kind of mill has a very few steel consumption and low rate of parts wear-out. The overall weight, particularly the weight of rotating parts of the device, is reduced considerably, therefore the energy consumption can be reduced and the efficiency improved remarkably.

Another object of this invention is to provide a mill with low noise, low vibration and no environment contamination.

A still another object of this invention is to provide a mill capable of performing the separating and crushing operation simultaneously.

The mill for realizing the above mentioned objects includes base, motor, milling chamber, inlet funnel, outlet port, and wherein;

said milling chamber is divided by a return funnel into an upper chamber and a lower chamber, a central channel being formed at the central portion of the return funnel and a return channel being formed between outer peripheral edge of the return funnel and the inner surface of the milling chamber, so as to circulate the material back and forth to the upper and lower chamber with high speed, causing the material to be crushed by collision and friction produced during high speed movement;

a rotating assembly driven by the motor through a shaft inserted into the milling chamber being provided in said lower chamber, so as to make the material to rotate at high speed;

a separating chamber being provided at central portion of the upper chamber, and a separating rotor being provided within said separating chamber and fixed on the shaft;

said outlet port being communicated with an output opening located at the top of said separating chamber.

In order to make the material to circulate more effectively at high speed through the upper and lower chamber, the body forming the milling chamber is divided into an upper body and a lower body, the upper chamber and lower chamber being formed respectively within the upper and lower body, a top cover being provided at the top of the upper body. Both of the upper and lower body have the shape of pyramid with the base ends of the two pyramids jointed together, so that the whole milling chamber looks like a Rugby with a larger middle portion and two small end portions.

Both the upper and lower body preferably have the shape of hex-pyramid. In other words, the horizontal section view perpendicular to the axis of the pyramid is a regular hexagon.

Each vertex angle of the pyramid forming the upper and lower body is preferably 120°.

In addition, a plurality of barricades are protruded vertically from each edge of the pyramidal upper and lower body, so that the material moving at high speed may accumulate, after crushed, on the corner formed by intersection of the barricades and the body to form a layer of material capable of protecting the body and barricades.

The rotating assembly includes a hub connected with the shaft, a base plate fixed on the outer peripheral surface of the hub, a plurality of rotor blades fixed at equal distance on the upper surface of the base plate, a plurality of bottom blades fixed at equal distance on the bottom surface of the base plate, and a protecting ring for connecting and strengthening the blades. A plurality of small holes are formed at the central portion of the base plate so as to allow the crushed material to pass through.

Alternatively, the above mentioned blades and strengthening rings may be replaced by a plurality of accelerating bars pivotally mounted at the central portion of the base plate. A concave surface coated with wolfram (tungsten) or wolfram alloy are formed on the side of the accelerating bars towards the rotation direction so as to prolong considerably the service life of the rotating assembly.

The motor is connected with the shaft by a ball bearing of the type used for universal coupling, so that the driving torque of the motor can be transmitted properly even when vibration or deviation occurs during the operation.

The bearing for supporting the shaft are suspended to the frame by means of a number of anti-vibration means with tension springs, which will reduce the vibration produced during the operation, particularly during starting and stop procedures.

The base may be made in form of triangle. A height adjustable supporting foot is provided at each corner of the base. The supporting foot consists of a ground foot of large surface and a screw-nut unit. The base has a good stability because it has a structure of three ground contacting points. Since the ground foot has a large supporting surface, the mill according to this invention may be installed directly on ground with various machnical property. The screw-nut unit is used for adjusting the verticality of the shaft.

In order to facilitate the install and maintenance, the mill is further provided a lifting device consisting of a height adjustable lifting frame, an electrical lifter mounted on the horizontal beam of the lifting frame, and steel ropes.

The outlet port of the inlet funnel is preferably located exactly above the central channel of the return funnel.

In order to maintain the temperature within the milling chamber to about 300° C. when the mill operates in dry milling manner, a heat absorbing water tank filled with circulating water is provided outside the lower body, which is able to absorb heat produced by the collision and friction between the material and therefore keep the strength of the steel plate (16Mn or 45Mn2) forming the body of the milling chamber to a optical degree. In addition, in order to prevent the damage of the bearing caused by too much heat transmitted to the bearing supporting the shaft, and another water tank filled with circulating water is provided below the bearing for supporting the shaft.

When the mill is used for operating in dry milling manner, according to the different requirement as to the granularity of the products, the separating propeller within the separating chamber may be provided with blades of different diameter and different helical angle.

When the mill is used for operating in dry milling manner, its outlet port may be connected with a extra-fine separating device. The extra-fine separating device includes a inlet funnel located at the upper portion of the separating chamber, a motor mounted near the outlet port, a housing which is connected with the outlet port and includes outlet funnel and subdivided outlet pipe. A shaft connected with the motor and inserted into the housing has staged blades fixed on the shaft.

When the mill is used for operating in dry milling manner, an air return port at the bottom of the milling chamber of the mill is connected with the housing of the extra-fine separating device by an air return pipe, so as to avoid the contamination caused by flying of the dust.

When the mill is used for operating in dry milling manner, the granularity of the product can be adjusted by a control valve mounted at the outlet port.

When the mill is used for operating in wet milling manner, said inlet funnel may be used to inlet water in addition to material.

The mill for wet milling may include further a floating device. The floating device includes an air inlet pipe which is mounted over the shaft and inserted into the milling chamber and has a plurality of air inlet holes at its upper portion and a plurality of air outlet holes at its lower portion; a slag discharge port located at the bottom of the milling chamber, a slag discharge valve mounted within the slag discharge port, and an oil tank for oil dropping into the inlet funnel used for floating separation.

Figure 1:
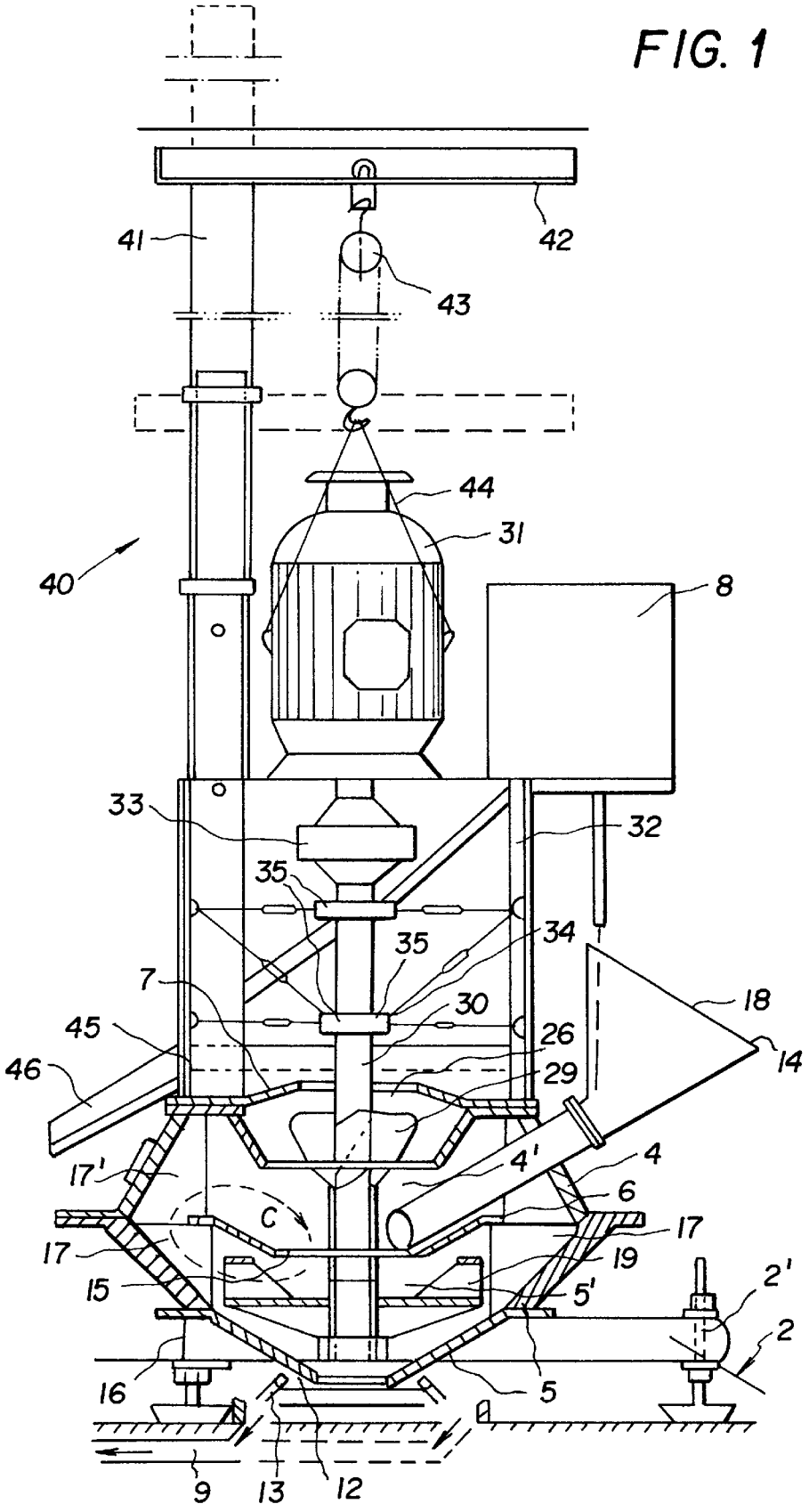
FIG. 1 is a schematically partial sectional view showing one embodiment of the mill according to this invention when operated in wet milling manner.
Figure 2:
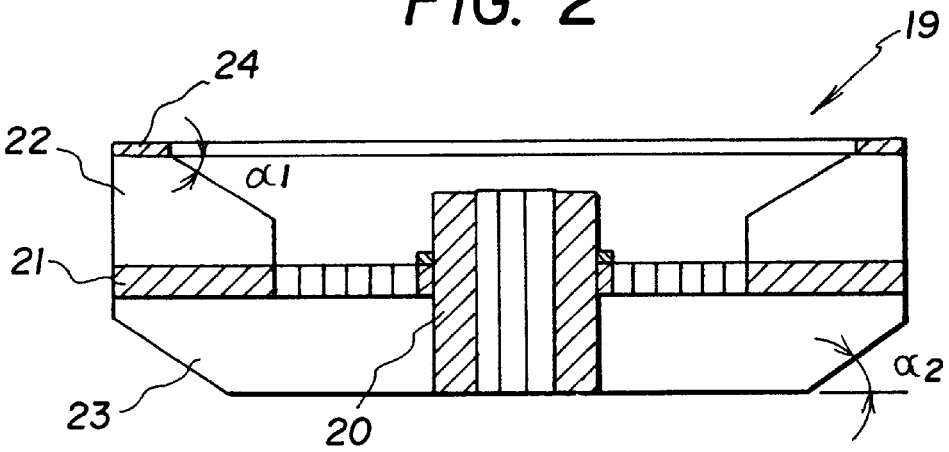
FIG. 2 is a schematic view showing the structure of the rotating assembly used in the embodiment of the mill according to this invention.
Figure 3:
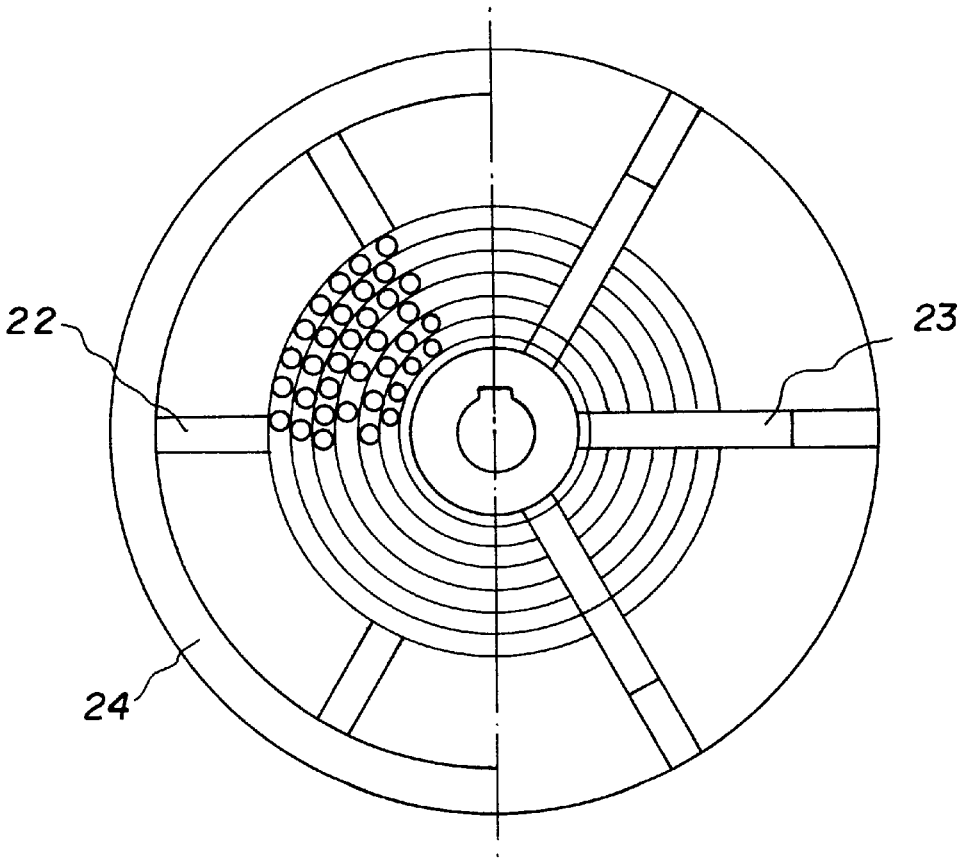
Figure 4:
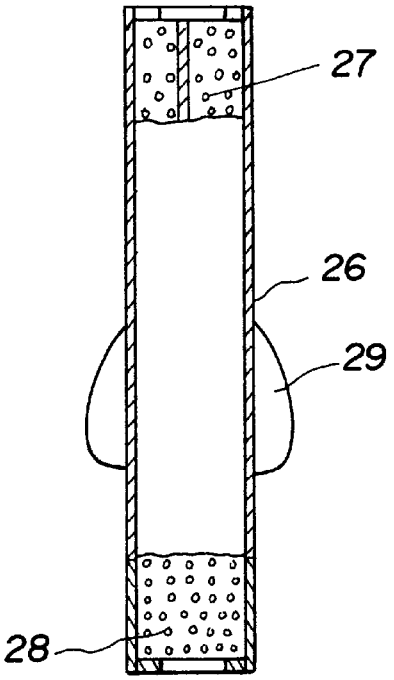
Figure 8:
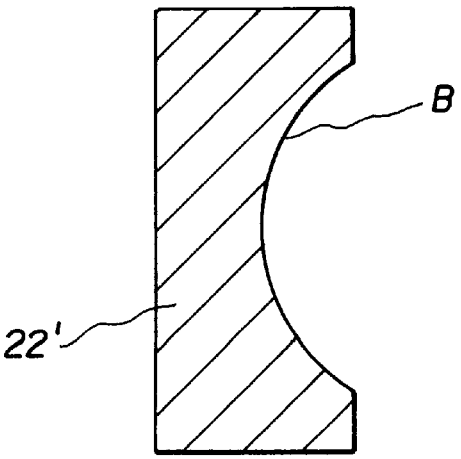
Figure 5:
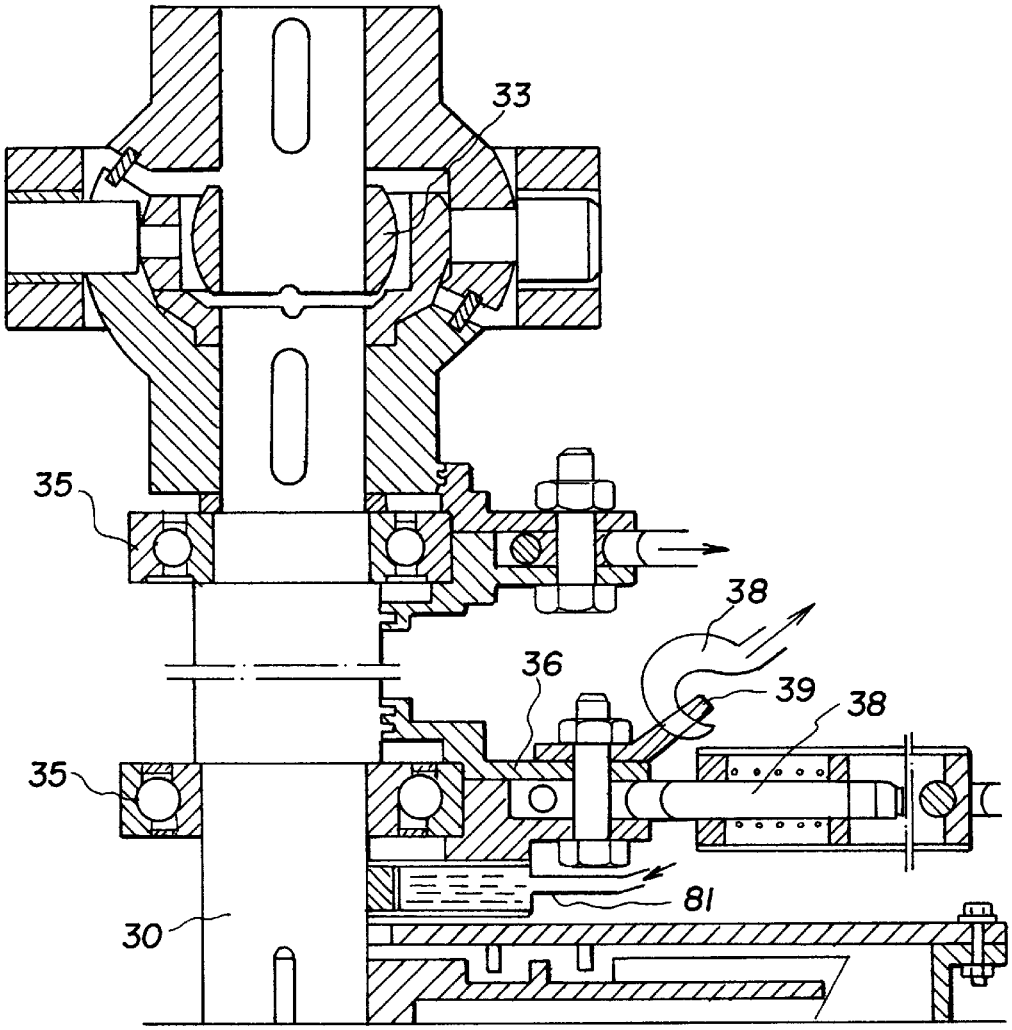
Figure 6:
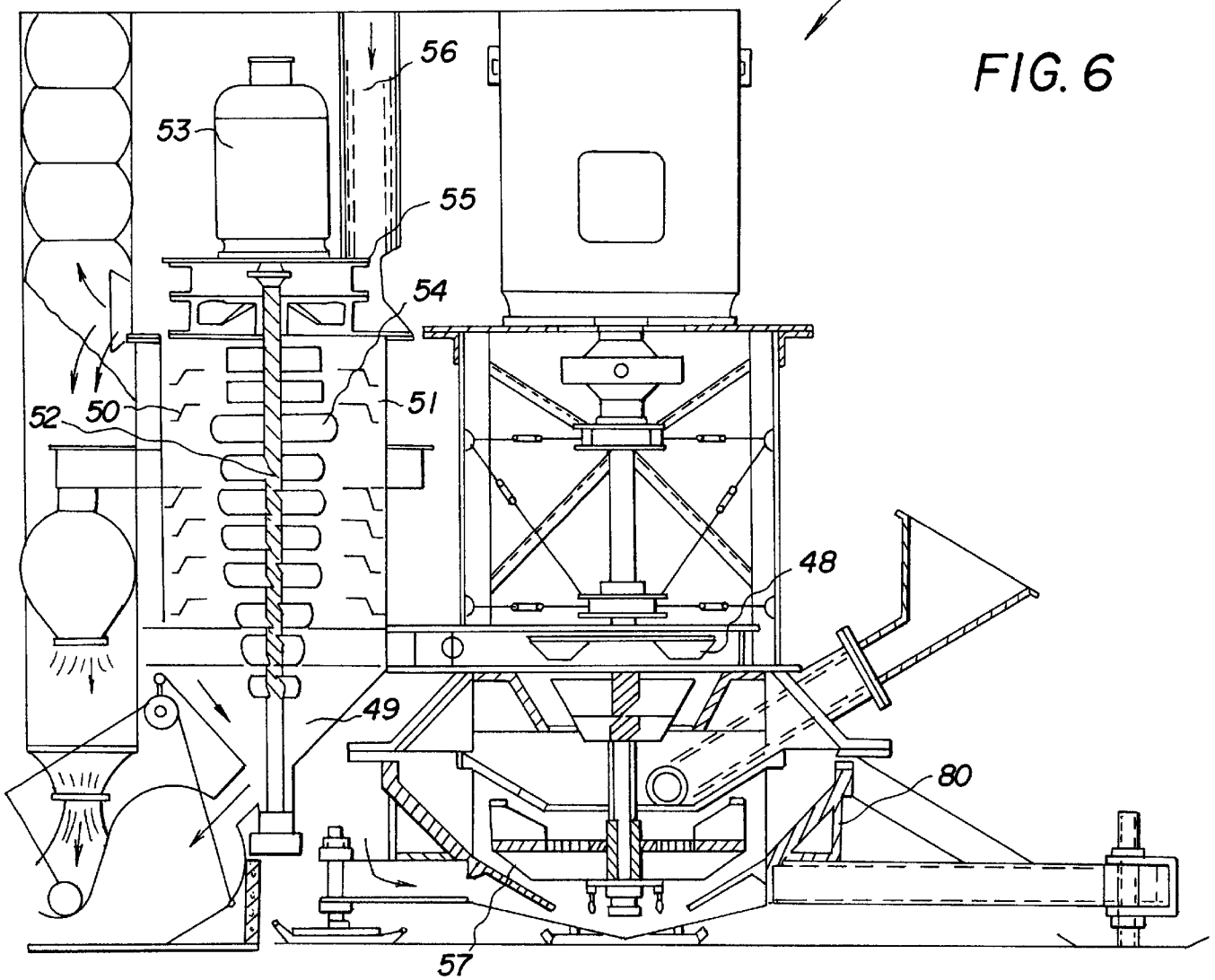
Figure 7:
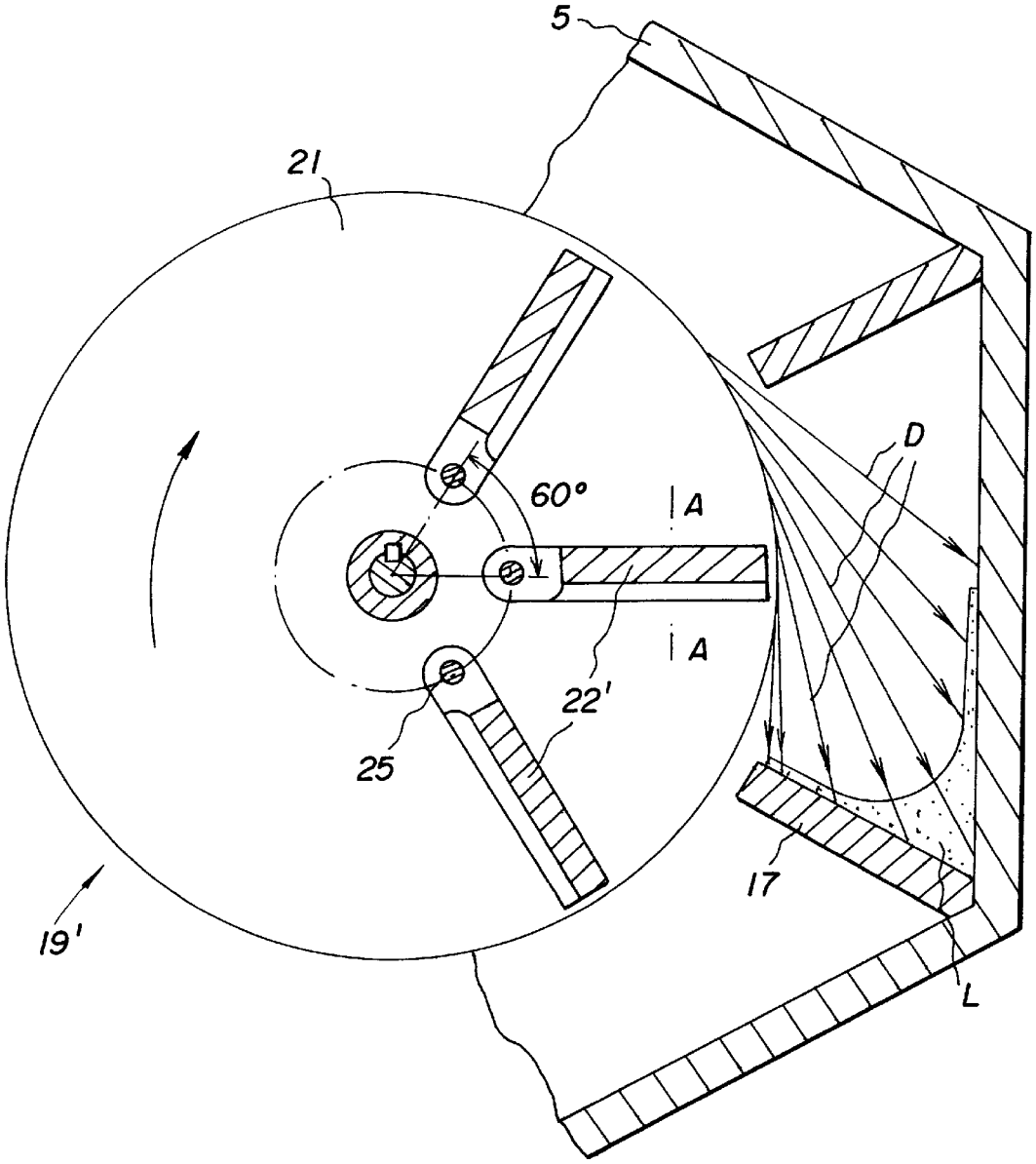

the left and right side of FIG. 3 are respectively the top and bottom view of the rotating assembly as shown in FIG. 2;

FIG. 4 is a schematic sectional view showing the structure of the air inlet pipe for floating separation as shown in FIG. 1;

FIG. 5 is schematic sectional view showing the ball bearing of the type used for universal coupling and spring suspension unit adopted in the mill according to this invention;

FIG. 6 is a schematic sectional view showing one embodiment of the mill according to this invention when operated in dry milling manner;

FIG. 7 is a schematic view showing another embodiment of the rotating assembly of the mill according to this invention as well as the crushing operation of the material;

FIG. 8 is the A—A sectional view of FIG. 7.

DESCRIPTION OF PREFFER EMBODIMENTS

The structure and operation of the mill according to the present invention will be described in detail with reference to the accompanying drawings.

Referring to FIG. 1, it shows an embodiment of the mill according to this invention, which is operated in wet milling manner and is provided with a floatation device. A milling chamber 3 consisting of upper body 4, lower body 5 and top cover 7 is fixed on an triangle base 1. As shown in FIG. 1, the upper body 4 and lower body 5 are both of hex-pyramid with the vertex angle of 120° and made by steel plate with the thickness of 40–50 mm. The larger ends of the upper and lower body 4,5 are jointed together. In order to prolong the service life of the body, lining layer may be provided on the inner surface of the bodies. A return funnel 6 is provided at the center of the milling chamber 3 to divide the milling chamber 3 into an upper chamber 4' and a lower chamber 5' formed respectively within the upper body 4 and lower body 5. A plurality of barricades 17,17' are mounted respectively on each edge of the hex-pyramid within the upper body 4 and lower body 5, which will cause the material in the milling chamber 3 to accumulate on the intersection corner of the barricades and the body so as to form a layer of material capable of protecting the body and barricades.

A frame 32 is secured on the top cover 7 for mounting motor 31, suspension frame 40, anti-vibration spring 34, etc.. The motor 31 is connected with a rotating shaft 30 through a ball bearing 33 of the type used for universal coupling. The shaft 30 is supported by two bearings 35, and the bearing seats of the bearings 35 are suspended within the frame 32 by means of a plurality of the anti-vibration springs through steel ropes (see FIG. 1 and FIG. 5).

The lower portion of the shaft 30 is inserted into the milling chamber 3. A rotating assembly 19 and an air inlet pipe 26 for floating separation are fixed respectively on this portion along the down-to-up direction by means of nut 33.

A conical cylinder with its larger end located upward is provided at the central portion of the top cover 7, and a separating chamber is formed within the conical cylinder. In this separating chamber, a separating rotor 29 is secured on the air inlet pipe 26, and the central hole of the top cover 7 is communicated with the outlet port 45 of the outlet channel provided on the top cover 7.

The rotating assembly 19 is located within in the lower chamber and has the structure as shown in FIGS. 2, 3. A hub 20 is fixed on the rotating shaft 30 by means of a key, and a base plate 21 is welded on the hub 20. A plurality of small holes are formed on the central portion of the base plate 21 so that the crushed powder of greater specific gravity may pass down to the bottom portion of the lower chamber. Six pieces of blade 22 are provided uniformly on the top surface of the base plate 21, and a reinforcing ring 24 is welded on the top of the blades 22. Another six pieces of blade 23 are provided at equal angular distance on the bottom surface of the base plate 21. The main function of the blade 22 is to make the material entered into the central space of the rotating assemble to rotate at high speed. Then, the material will be thrown out along the tangential direction of the peripheral edge of the rotating assembly 19 by the centrifugal force produced during high speed rotation. The material thrown out will collide and rub with the material staying previously adjacent to the wall of the body so as to cause the material crushed. The manner by which the material are crushed will be explained more detail hereinafter in connection with the description for the operation procedure of the mill of the present invention. In addition to the effect of reinforcing the base plate 21, the bottom blades 23 also play the role of a fan. The upper and inner corner of each blade 22 is cutaway and the lower and outer corner of each bottom blade 23 is also cutaway, so that a uniform space is formed respectively between the blades and the declined surface of the funnel 6 and the lower body, which will avoid the interference produced between them. The declining angle $\alpha 1$ and $\alpha 2$ of the cutaway corner should coincide with the declining angle of the lower body and the funnel. The speed of the material thrown out from the rotating assemble may be as high as 40–120 m/sec.

FIG. 7 shows schematically the structure of another embodiment of the rotating assembly 19'. In the rotating assemble 19' the blades 22 are replaced by accelerating bars 22'. The accelerating bars 22' are pivotally mounted on the central portion of the base plate by means of rotating pins 25 so that they may swing around the pins freely to produce a buffering effect during impacting with the material. The lateral sectional view of the accelerating bars 22' is shown in FIG. 8. It can seen from FIG. 8 that a concave surface B is formed at one side of the bar toward the rotating direction of the rotating assembly. A layer of wolfram (tungsten) powder or wolfram alloy is plated on the concave surface B and then polished. It has been proved by experiment that the rotating assembly of the above mentioned structure may reduce the wearing rate of the accelerating bars (or blades) to a minimum degree.

Turn back to FIG. 1, three height-adjustable supporting feet 2 are provided respectively one at each corner of the triangle base 1 for adjusting the horizontality of the base 1 or the verticality of the rotating shaft 30 within the milling chamber. The adjusting unit includes screw stem 2' and nut engaged with the screw stem. Since the supporting feet 2, as shown in FIG. 1, has a large bottom surface contacting with the ground, it is possible to set the mill directly on different kinds of ground without the necessity of constructing special foundation for it.

An inlet funnel 14 is inserted into the upper chamber with its output port located adjacent to the central pass 15 of the return funnel 6, so that the material to be processed can enter easily into the lower chamber to obtain the required high rotating speed. An oil tank 8 is filled with oil for floating separation. The oil can drop into the return funnel 14 through the pipe located at the lower part of the tank and then enter the milling chamber together with the material.

A horizontal beam 42 is protruded transversely from the top of the suspension frame 40 and an electrical lifter 43 mounted on the beam 42 can move freely along the horizontal beam 42. The vertical beam 41 of the suspension frame 40 has a telescopic structure, so that the operation of assembling and disassembling heavy parts during the assembling and maintaining procedure can be carried out by the device itself. This feature makes the device suitable for field operation.

FIG. 4 shows an air inlet pipe 26 for floating separation which is designed for this embodiment. The upper portion of the pipe 26 is outside the top cover 7 of the milling chamber and a plurality of air inlet holes 27 are formed on this portion. The lower portion of the pipe 26 is inserted into the center of the milling chamber and a plurality of air outlet holes 28 are formed on the peripheral surface of the this portion. By means of the negative pressure produced at the central portion of the lower chamber 5' during the rotation of the rotating assembly, air may be sucked into the air inlet pipe 26 through the air inlet holes 27 and then released in the form of air bubbles from the air outlet holes 28 to produce the air bubbles needed for carry out the floating separation.

The operation of the mill according to this invention operated in wet milling manner together with the floating separation device will now be described in detail.

Material with granular size less than 100 mm, water, and oil for floating separation enter into the central of the milling chamber 3 through the inlet funnel 14. The motor 31 will, when turned on, drive the shaft 30 and the rotating assembly to rotate at high speed, so that the water (optionally oil) and the material will also rotate at high speed around the rotating axis by means of the blades 22 (or bars 22'). Due to the centrifugal force produced during the rotation, water and material will move radically toward the outer edge while rotating around the axis. Moreover, the material move radically in a rolling manner. When the material arrive at the outer edge of the blades 22 (or bars 22'), they will be thrown out along the tangential direction with a speed as high as about 40 m/s. As shown by the arrow D in FIG. 7, during the period that the blades 22 (or bars 22') rotate across an angle of 60°, the material flying out from this sector will either impact directly on the corner L formed by barricades 17 and lower body 5 or be reflected toward the corner L. Therefore, the crushed material will accumulate at the corner L to form a protective layer. The material flying out from the rotating assembly thereafter will impact on the material accumulated previously and be crushed by the collision and friction produced between the material themselves.

Since the lower body has a pyramidal shape with its larger end located upward, the material impacting on the wall of the lower body 5 will obtain a velocity component of upward movement, so that the crushed material will move toward the upper chamber through the gap between the return funnel and the body as shown in FIG. 1. Since the upper body 4 has a pyramidal shape with its larger end downward, the material impacting on the wall of upper body 4 will have a tendency to move downward and centripetally. In addition, a negative pressure will be produced at the central portion by means of the outward movement of the water and the material. For these reasons, the material will fall to the central portion of the milling chamber and return back to the lower chamber 5' through the central pass 15 of the return funnel 6. The material will move back and forth in such a manner to form a cycling movement. The overall movement path of the material during the milling operation may be represented by the circle of dotted line and arrow C as shown in FIG. 1.

Since the speed of water is 5–10 times lower than that of material, the power output of the motor is used mainly for driving the material to collide with each other.

In addition, the rotor 29 mounted on the air inlet pipe 26 for floating separation rotates together with the shaft 30 too, it makes the air bulbs and water entered into the milling chamber through the air outlet holes 28 to carry the crushed material of the predetermined size to flow upward through the hole at the central portion of the top cover 7 into the outlet channel, and then to flow from the outlet port 45 into a collecting channel ( not shown). The material of larger size will be thrown out by the rotor 29 and then fall down into the central portion of the milling chamber after impacting with the inner wall of the central cone 18 of the top cover 7 so as to rejoin the cycling of the material.

The fine powder will fall down through a plurality small holes on the central portion of the base plate 21 into the bottom of the lower chamber, among which, the powder of relatively small specific gravity will be thrown out again by the bottom blades and flow toward the upper part of the lower chamber, and the slag powder of relatively larger specific gravity will deposit gradually on the bottom. When a slag discharge valve 13 is opened, the slag will be discharged through the valve within a slag discharge port 12 into an underground channel.

The mill of the embodiment may also be used only for wet milling without floating separation. For this purpose, it is only necessary to cancel the air inlet holes and air outlet holes on the two ends of the pipe 26 and to stop the oil dropped into the return funnel.

Referring to FIG. 6, which shows schematically the structure of the mill according to this invention for dry milling, which is operated together with a extra-fine separating device. The structure and effect of the mill for dry milling is substantially the same as that of the mill for wet milling as mentioned above, except for only material and air put into the milling chamber through the return funnel, without water and oil.

In addition, since the heat conducting effect of air is much poorer than that of water, in order to prevent the reduction of strength of various part of the device due to overheating caused by the heat produced during the milling procedure, a cooling water jacket 80 is added outside of the lower body for cooling the lower body by cycling water. In addition, in order to prevent damage of the bearing caused by the heat conducted to it, a cooling water jacket 81 filled with cycling water is also provided at the location below the bearing (shown in FIG. 5).

The extra-fine separating device as shown in the left side of FIG. 6 has the following structure. The motor 53 installed at the top of the frame is connected with a shaft 52 through a coupling. The shaft 52 is inserted into a housing 51. A suction fan and several groups of staged blades 54 are fixed respectively on the shaft 52. With respect to each group of the blades 54, each one outlet port 50 is provided on the body 51 to output the product powder of different size into different bags connected with respect outlet ports. An air return port 55 is designed on the upper part of the housing, one end of the port 55 is communicated with an air return pipe 56 and another end is communicated with an air return port 57 located at the bottom of the milling chamber.

In the separating chamber, the fine powdered material are pushed upward by the propeller of the separator fixed on the shaft. When arriving at the edge of upper port of the separating chamber, the powders of relatively larger size will, due to the reduction of the push force as well as the effect of relatively larger weight, fall back to the milling chamber for further milling. The powder of relatively smaller size will pass through the outlet port and enter into the extra-fine separating device.

The dimension and angle of the blades of the above mentioned separating rotor may by selected according to different requirements respect to the size of powder and specific gravity of the material so as to obtain the product with satisfactory granularity. In addition, the granularity of the separated product may also be adjusted by changing the opening degree of the butterfly valve mounted at the outlet port.

After the material leaving from the outlet port enter into the extra-fine separating device along the tangential direction, the powder of largest size will at first be collected in the funnel 49 by means of a cyclone process and then outputted from the lower port. Then, the air flow will move upward to separate the material of different size by means of different groups of staged blades. The separated material of different size will be outputted into respect bags. Finally, the air flow with very small amount of remained powders will return back to the lower part of the milling chamber through the air return port 55 and air return pipe 56.

The non-ball mill according to this invention has the following advantageous:

1. In comparison with the known ball mill, the consumption of steel can be reduced to about zero and the productivity is rather high since the material are crushed by the high speed collision and friction produced among themselves.

2. In comparison with the known ball mill, the steel material required for making the device is reduced by 90%. The weight of the rotating part takes only 10% of the overall weight of the device, so that the electricity consumption may be reduced to ⅕, which in turn increase considerably the economic efficiency.

3. Since the milling chamber is designed to have a pyramidal shape and a barricade is provided at each edge of the pyramid, the material are circulated automatically within the milling chamber along a cycling path and are accumulated at the intersection corners of the body and barricades to form a protective layer, so that the wearing rate of the body or its lining layer nay be reduced while the milling efficiency increased.

4. Since the adoption of the height adjustable triangle supporting feet for adjusting the main shaft to an exact vertical position, the adoption of the ball bearing of the type used for universal coupling for connecting motor and shaft, as well as the adoption of elastic anti-vibration device, the mill has the features of low noise and vibration, which enable the device to be set directly on ground of any kind without the necessity of foundation construction.

5. Since a lifting device is provided, the device may by installed and maintained conveniently.

6. The mill according to this invention may combine the crushing and separating operation into one single device, it can be used either for wet milling with floating separation or for dry milling with multiple-staged separation.

I claim:

1. A mill comprising:

a base;

a body mounted on the base and defining a milling chamber, the body having an inlet port and an outlet port;

a return funnel positioned in the milling chamber and dividing the milling chamber into an upper chamber and a lower chamber, the funnel having a central channel formed at central portion of the return funnel, the funnel defining a return channel between an outer peripheral edge of the return funnel and an inner surface of the milling chamber;

a frame extending above the body and supported thereon;

a motor mounted on the frame;

a shaft connected to the motor and extending into the milling chamber;

a rotating assembly rotatably provided in the lower chamber and driven by the shaft connected to the motor, centrifugally forcing materials in the lower chamber to be driven against the inner surface of the milling chamber causing the material to be crushed by collision and friction produced during high speed movement and causing the crushed material to circulate through the return channel, the upper chamber, and the central channel back to the lower chamber with high speed;

a separating chamber being provided at a central portion of the upper chamber; and a separation rotor provided within the separating chamber and fixed on and rotating with the shaft;

the outlet port being communicating with an output opening located at the top of the separating chamber.

2. A mill according to claim 1, wherein the body forming the milling chamber comprises an upper body and a lower body, each of the upper body and the lower body being a pyramid shape having with a larger end of each of the two pyramid shapes joined together to form the body, the upper chamber and lower chamber being formed respectively within the upper body and lower body, and wherein a top cover is provided at the top of the upper body.

3. A mill according to claim 2, wherein each the pyramid shape is a hexagonal pyramid having the large end being a six sided base.

4. A mill according to claim 3, wherein the vertex angle of each pyramid shape is 120°.

5. A mill according to claim 2, further comprising a plurality of vertical plate barricades are provided in the upper body and in the lower body, each plate barricade in the lower body extending from the inner surface of the lower body to a position adjacent the rotating assembly.

6. A mill according to any one of claims 1–5, wherein the rotating assembly includes a hub connected with the shaft, a base plate fixed on an outer peripheral surface of the hub, a plurality of rotor blades fixed at equal distance apart on an upper surface of the base plate, a plurality of bottom blades fixed at equal distance apart on a bottom surface of the base plate, and a protective ring connected to upper edges of the rotor blades, wherein a plurality of small holes are formed in a central portion of the base plate allowing crushed material to pass therethrough.

7. A mill according to claim 6, wherein the shaft is supported on the frame by bearings, the bearings including bearing seats and ball bearings in the bearing seats, and the bearing seats are suspended to the frame by plural anti-vibration springs.

8. A mill according to claim 6, wherein the base is in the shape of a triangle having three corners, and the mill further comprises a height adjustable supporting frame provided at each corner of the base, each the height adjustable supporting frame including a ground foot and a screw-nut unit adjustably connecting the ground foot to the corner.

9. A mill according to claim 6, wherein the mill further includes a lifting device for maintenance comprising of a height adjustable lifting frame, an electrical lifter mounted on a horizontal beam of the lifting frame, and steel rope attached to the motor and operatively associated with the electric lifter.

10. A mill according to claim 6, wherein the inlet port includes an inlet funnel for providing water in addition to material into the body.

11. A mill according to any one of claims 1–5, wherein the rotating assembly includes a hub connected with the shaft, a base plate fixed on an outer peripheral surface of the hub, a plurality of bottom blades fixed at equal distance apart on a bottom surface of the base plate, and a plurality of accelerating bars pivotally mounted at a central portion of the base plate, wherein a plurality of small holes are formed in the central portion of the base plate allowing crushed material to pass therethrough, and the side of the accelerating bars each have a side oriented in a direction toward a rotating direction of the rotating assembly, the side having a concave surface coated with a layer of tungsten or tungsten alloy.

12. A mill according to claim 11, further comprising a heat absorbing water jacket provided outside and surrounding the lower body; and a cooling water jacket adjacent a bearing supporting the shaft.

13. A mill according to claim 12, wherein the separation rotor is provided with blades having a helical angle.

14. A mill according to claim 12, further comprising an extra-fine separating device connected to the outlet port, the extra-fine separating device including a separating device inlet funnel located at an upper portion of the separating chamber, a motor mounted near the outlet port, a separating body connected with the outlet port and including an outlet funnel and a subdivided outlet pipe, a shaft connected with the motor and inserted into the separating body, and plural stepped blades fixed on the shaft.

15. A mill according to claim 14, wherein a bottom of the milling chamber has an air return port and an air return pipe connects the separating body to the air return port.

16. A mill according to claim 12, further comprising an output control valve on the outlet port for adjusting the granularity of outputted material.

17. A mill according to claim 11, wherein the shaft is supported on the frame by bearings, the bearings including bearing seats and ball bearings in the bearing seats, and the bearing seats are suspended to the frame by plural anti-vibration springs.

18. A mill according to claim 11, wherein the base is in the shape of a triangle having three corners, and the mill further comprises a height adjustable supporting frame provided at each corner of the base, each the height adjustable supporting frame including a ground foot and a screw-nut unit adjustably connecting the ground foot to the corner.

19. A mill according to claim 11, wherein the mill further includes a lifting device for maintenance comprising a height adjustable lifting frame, an electrical lifter mounted on a horizontal beam of the lifting frame, and steel rope attached to the motor and operatively associated with the electric lifter.

20. A mill according to claim 11, wherein the inlet port includes an inlet funnel for providing water in addition to material into the body.

21. A mill according to any one of claims 1, 2 and 5, wherein the shaft is supported on the frame by bearings, the bearings including bearing seats and ball bearings in the bearing seats, and the bearing seats are suspended to the frame by plural anti-vibration springs.

22. A mill according to any one of claims 1, 2 and 5, wherein the base is in the shape of a triangle having three corners, and the mill further comprises a height adjustable supporting frame provided at each corner of the base, each the height adjustable supporting frame including a ground foot and a screw-nut unit adjustably connecting the ground foot to the corner.

23. A mill according to any one of claims 1, 2 and 5, wherein the mill further includes a lifting device for maintenance comprising a height adjustable lifting frame, an electrical lifter mounted on a horizontal beam of the lifting frame, and steel rope attached to the motor and operatively associated with the electric lifter.

24. A mill according to any one of claims 1, 2 and 5, wherein the inlet port includes an inlet funnel for providing water in addition to material into the body.

25. A mill according to claim 24, wherein an output port of the inlet funnel is positioned above the central channel of the return funnel.

26. A mill according to claim 24, further comprising a floating device, the floating device including an air inlet pipe located outside the shaft and inserted into the milling chamber, the air inlet pipe having a plurality of air inlet holes at an upper portion and a plurality of air outlet holes at a lower portion, a slag discharge port located at the bottom of the milling chamber, a slag discharge valve mounted within the slag discharge port, and an oil tank for dropping oil into the return funnel for floating separation of the crushed material.

* * * * *